US011549420B2

(12) United States Patent
Kuroda

(10) Patent No.: US 11,549,420 B2
(45) Date of Patent: Jan. 10, 2023

(54) OUTBOARD MOTOR CATALYTIC CONVERTER

(71) Applicant: HONDA MOTOR CO., LTD., Tokyo (JP)

(72) Inventor: Tatsuya Kuroda, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/425,532

(22) PCT Filed: Nov. 13, 2019

(86) PCT No.: PCT/JP2019/044571

§ 371 (c)(1),
(2) Date: Jul. 23, 2021

(87) PCT Pub. No.: WO2020/161983

PCT Pub. Date: Aug. 13, 2020

(65) Prior Publication Data

US 2022/0186650 A1 Jun. 16, 2022

(30) Foreign Application Priority Data

Feb. 4, 2019 (JP) ..... JP2019-017842

(51) Int. Cl.
*F01N 3/28* (2006.01)
*F01N 13/14* (2010.01)

(52) U.S. Cl.
CPC ..... *F01N 3/28* (2013.01); *F01N 13/14* (2013.01)

(58) Field of Classification Search
CPC ..... F01N 3/28; F01N 13/14; F01N 13/004; F01N 13/08; F01N 13/141; F01N 13/16; F02B 67/00; F02B 77/11
(Continued)

(56) References Cited

U.S. PATENT DOCUMENTS 4,906,214 A * 3/1990 Towner ..... F01N 13/12 440/89 R
5,100,351 A * 3/1992 Shibata ..... B63H 20/245 440/89 R
(Continued)

FOREIGN PATENT DOCUMENTS

JP 59-165519 11/1984
JP H01-153571 6/1989
(Continued)

OTHER PUBLICATIONS

International Search Report, dated Dec. 24, 2019, 2 pages.
(Continued)

*Primary Examiner* — Tom P Duong
(74) *Attorney, Agent, or Firm* — Rankin, Hill & Clark LLP

(57) ABSTRACT

An outboard motor catalytic converter that can downsize an outboard motor by making a space, where catalysts are installed, small and can ensure efficient reaction of the catalysts. The outboard motor catalytic converter includes exhaust pipes that are connected to exhaust manifolds of an engine of the outboard motor. Catalysts are installed inside the exhaust pipes, and at least a portion of each of the exhaust pipes, which corresponds to a place where the catalysts are installed, is formed to have a double structure constituted of an inner pipe and an outer pipe.

9 Claims, 6 Drawing Sheets

(58) Field of Classification Search
USPC ..... 422/168; 440/89 R, 89 C
See application file for complete search history.

(56) References Cited

U.S. PATENT DOCUMENTS

| | | | | |
|---|---|---|---|---|
| 5,174,112 | A * | 12/1992 | Sougawa | F01N 3/046 440/89 C |
| 5,730,632 | A * | 3/1998 | Murata | F01N 13/004 60/302 |
| 2013/0157533 | A1* | 6/2013 | Kato | B63H 20/002 440/88 L |
| 2013/0157534 | A1* | 6/2013 | Suzuki | F02M 61/14 440/88 F |
| 2014/0041371 | A1* | 2/2014 | Nakayama | F01N 3/046 60/321 |

FOREIGN PATENT DOCUMENTS

| | | |
|---|---|---|
| JP | H03-63494 | 3/1991 |
| JP | 3002348 | 7/1994 |
| JP | H06-185181 | 7/1994 |
| JP | 2000-274233 | 10/2000 |
| JP | 2005-233053 | 9/2005 |
| JP | 2008-08816 | 4/2008 |
| JP | 2009-085138 | 4/2009 |
| JP | 2013-222038 | 10/2013 |
| JP | 2017-078479 | 4/2017 |

OTHER PUBLICATIONS

Written Opinion of the International Searching Authority dated Dec. 24, 2019 in PCT/JP2019/044571, 5 pages.
International Preliminary Report on Patentability, dated Aug. 19, 2021, 9 pages.

* cited by examiner

OUTBOARD MOTOR CATALYTIC CONVERTER

TECHNICAL FIELD

The present invention relates to an outboard motor catalytic converter.

BACKGROUND ART

Conventionally, there has been proposed a structure of an outboard motor in which a catalyst connected to an engine to purify exhaust gas from the engine is installed.

In general, as a disclosed technology for installing the catalyst, for example, there is a technology in which a catalyzer unit is configured to have a double structure constituted of an inner cylinder and an outer cylinder, a catalyst is retained in the inner cylinder by a cushion member, and the outer cylinder is supported via a ring spacer outside the inner cylinder (for example, Patent Literature 1).

In addition, another disclosed technology is, for example, a technology in which in an exhaust gas purification catalytic converter including: a metal carrier catalyst which has a metallic core and a metallic inner cylinder; and a metallic outer cylinder which is provided on an outer circumferential side of the inner cylinder and constitutes an insulator between an outer circumferential surface of the inner cylinder and the outer cylinder, a thickness of the inner cylinder is thinner than that of the outer cylinder (for example, Patent Literature 2).

CITATION LIST

Patent Literature

[Patent Literature 1]
Japanese Utility Model Application Laid-Open No. 59-165519
[Patent Literature 2]
Japanese Patent Application Laid-Open No. 2000-274233

SUMMARY OF INVENTION

Technical Problem

However, in each of the technologies disclosed in the above-mentioned Patent Literatures, a catalytic converter itself to which the catalyst is attached is doubly formed, and in a case where the catalytic converter is attached in a place ahead of an exhaust manifold or an exhaust pipe, it is required to ensure a large space where the catalytic converter is attached, thereby leading to a problem of an increased size of the outboard motor itself.

Therefore, an object of the present invention is to provide an outboard motor catalytic converter which allows an outboard motor to be downsized by decreasing a space where catalysts are installed and enables efficient catalyst reaction to be ensured.

Solution to Problem

In order to achieve the above-mentioned object, an aspect of the present invention includes an exhaust pipe which is connected to an exhaust manifold of an engine of an outboard motor, inside the exhaust pipe, a catalyst is installed, and at least a portion, of the exhaust pipe, where the catalyst is installed is formed to have a double structure constituted of an inner pipe and an outer pipe.

In the above-described configuration, a portion of the double structure of the exhaust pipe has a heat-resistant structure.

In the above-described configuration, the heat-resistant structure is constructed with any of glass wool, rock wool, or a reinforced carbon composite material incorporated in a space between the inner pipe and the outer pipe.

In the above-described configuration, the heat-resistant structure is constructed with a plastic-based heat insulation material installed on an outer surface of the outer pipe.

In the above-described configuration, the plastic-based heat insulation material is any of extruded foamed polystyrene, expanded poly-styrene, urethane foam, highly foamed polyethylene, or phenol foam.

In the above-described configuration, in the heat-resistant structure, the space between the inner pipe and the outer pipe is at a low pressure or is vacuum.

In the above-described configuration, the heat-resistant structure is constructed by subjecting an outer surface of the inner pipe and an inner surface of the outer pipe to mirror finish.

In the above-described configuration, the portion, of the exhaust pipe, where the catalyst is installed is formed by joining tube members by welding, the tube members being the exhaust pipe divided into two halves.

In the above-described configuration, as the catalyst, two catalysts are installed.

In the above-described configuration, a watering inhibition mechanism is installed in an exhaust port of the exhaust pipe.

Note that in this specification, Japanese Patent Application No. 2019-017842, filed on Feb. 4, 2019, is incorporated in its entirety.

Advantageous Effect of Invention

According to an aspect of the present invention, since owing to a double-pipe structure of each of exhaust pipes, a temperature outside an outer pipe is hardly transmitted to an inner pipe, an inside of the inner pipe is retained at a predetermined temperature by exhaust gas, and thus, oxidation-reduction reaction of catalysts which are located inside the inner pipe can be favorably caused. In addition, since the catalysts are installed inside the inner pipe of each of the exhaust pipes, it is not required to separately provide a space where the catalysts are installed, thereby allowing a space where the catalysts are installed to be made small. As a result, an outboard motor can be downsized.

DESCRIPTION OF EMBODIMENT

Hereinafter, with reference to the accompanying drawings, an embodiment of the present invention will be described.

Figure 1:
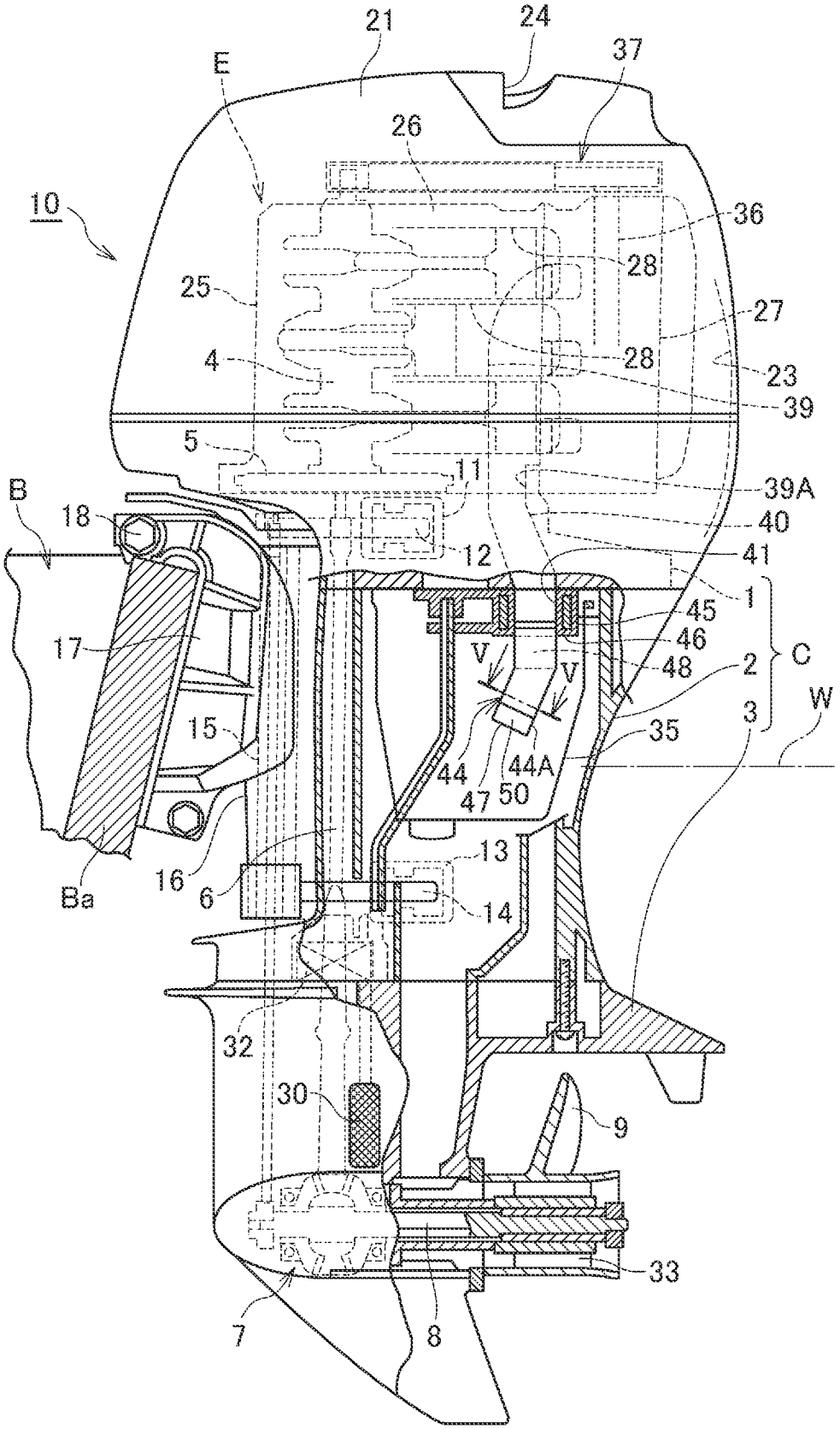
FIG. 1 is an essential part longitudinal sectional side view of an outboard motor according to the present embodiment.

FIG. 1 is an essential part longitudinal sectional side view of an outboard motor 10 according to the present embodiment. Note that in the below description, front, rear, right, and left are defined based on a state in which a boat B having an outboard motor 10 mounted thereon is planarly viewed.

As illustrated in FIG. 1, the outboard motor 10 has a casing C, and this casing C is constituted of a mount case 1, an extension case 2 which is connected to a lower end surface of the mount case 1, and a gear case 3 which is connected to a lower end surface of the extension case 2. On an upper end surface of the mount case 1, a multicylinder engine E is mounted with a crank shaft 4 longitudinally mounted.

The outboard motor 10 is provided with a pair of right and left upper arms 12 which support the mount case 1 via an upper mount rubber 11 and a pair of right and left lower arms 14 which support the extension case 2 via a lower mount rubber 13. Between these upper arms 12 and lower arms 14, a swivel shaft 15 is connected. In addition, a swivel case 16 which rotatably supports the swivel shaft 15 is upwardly and downwardly swingably supported via a tilt shaft 18 in a horizontal direction with respect to a stern bracket 17 which is attached to a transom Ba of the boat B.

An undercover (not illustrated) which is formed of synthetic resin and is ring-shaped is fixedly attached to the mount case 1. This undercover covers the periphery of a section from a lower portion of the engine E to an upper portion of the extension case 2, and on an upper end of the undercover, an engine hood 21 which covers the engine E from above is detachably attached. An engine room 23 which houses the engine E is defined by the engine hood 21 and the undercover. In an upper portion of the engine hood 21, an air intake port 24 from which air is taken into the engine room 23 is provided.

Connected to a lower end of the crank shaft 4 is a driving shaft 6 together with a flywheel 5. This driving shaft 6 extends downward in an inside of the extension case 2, a lower end of the driving shaft 6 is connected to a propeller shaft 8 in a horizontal direction via a forward/backward traveling switching mechanism 7 which is provided in an inside of the gear case 3, and on a rear end of the propeller shaft 8, a propeller 9 is fixedly attached.

The engine E has a crank case 25 which supports the longitudinally mounted crank shaft 4, a cylinder block 26 which extends backward from the crank case 25, and a cylinder head 27 which is joined to a rear end of the cylinder block 26. A lower surface of the crank case 25 is bolt-connected to the mount case 1. The cylinder block 26 includes a plurality of cylinders 28 which are arranged on upper and lower sides.

In a lower portion of the gear case 3, a water intake port 30 which opens in a one side surface thereof and through which outside water is taken in is provided. The outside water taken in from the water intake port 30 is pneumatically fed by a water pump 32 to the engine E as cooling water and cools respective parts of the engine E. The cooling water which has finished cooling of the engine E is released into the extension case 2 and is discharged outside through a discharge hole 33 which is formed in a boss of the propeller shaft 8.

Connected to a lower surface of the mount case 1 is an oil pan 35 which is located in the central portion of an upper portion inside the extension case 2, and lubricating oil which is supplied to the parts of the engine E is stored in the oil pan 35.

Right and left camshafts 36 for a valve system, which are in parallel with the crank shaft 4, are rotatably supported to the cylinder head 27. A belt-type timing transmission device 37 which drives these camshafts 36 at a predetermined speed reduction ratio from the crank shaft 4 is disposed above the cylinder block 26.

The cylinder head 27 is provided with an exhaust manifold 39 which communicates with a plurality of exhaust ports. An exhaust outlet 39A which opens in a lower end of the exhaust manifold 39 communicates with a tubular exhaust passage 40 which extends on a lower surface of the mount case 1. On the lower surface of the mount case 1, the exhaust passage 40 is joined to an exhaust guide 41 which is connected to the oil pan 35 inside the extension case 2. A connecting flange 45 which is formed at an upper end of the exhaust pipe 44 is flange-connected to a lower end part of the exhaust guide 41 with a bolt 46. The exhaust pipe 44 extends downward in the inside of the extension case 2, an exhaust port 47 of a lower end part 44A opens in the casing C, and exhaust gas of the engine E is discharged inside the casing C. Below a height at which the exhaust port 47 of the lower end part 44A is located, a waterline W upon normal navigation of the boat B is located.

Figure 2:
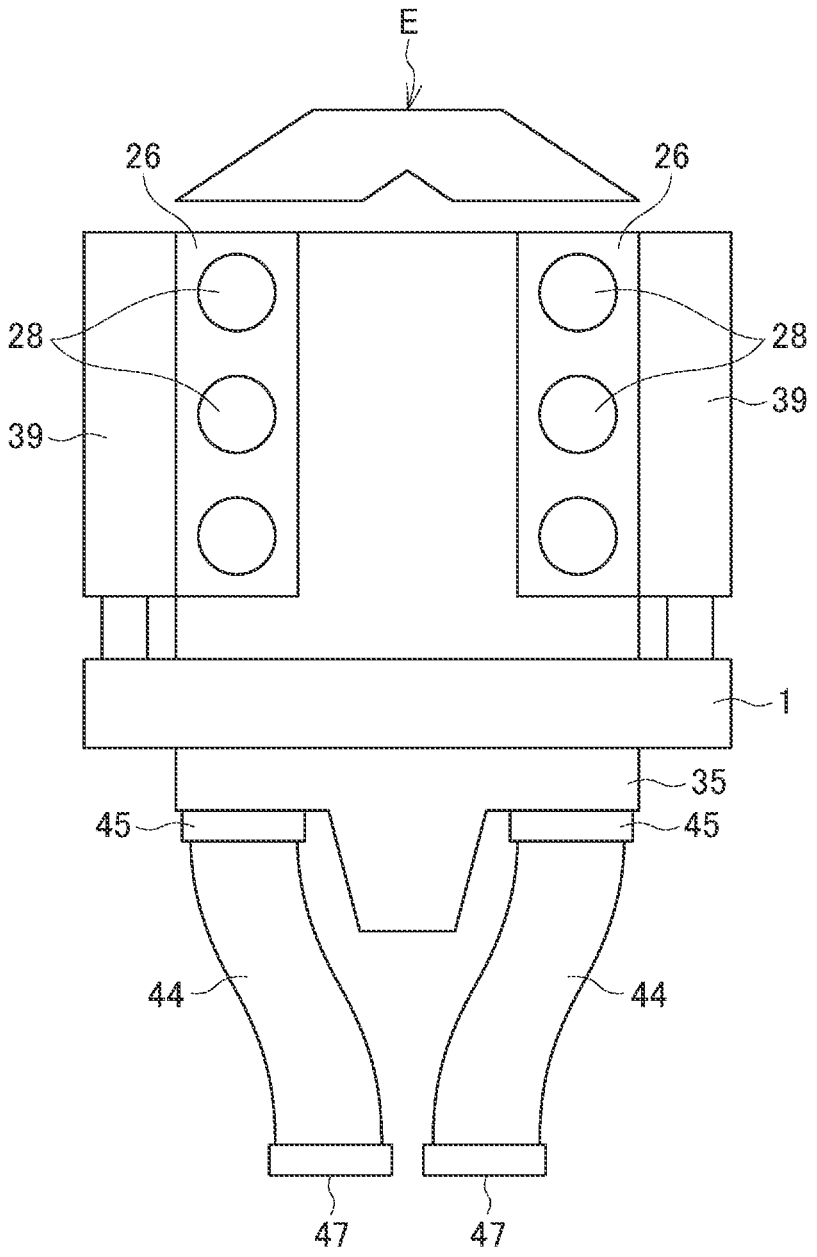
FIG. 2 is a schematic block diagram schematically illustrating an exhaust structure of an engine.
Figure 3:
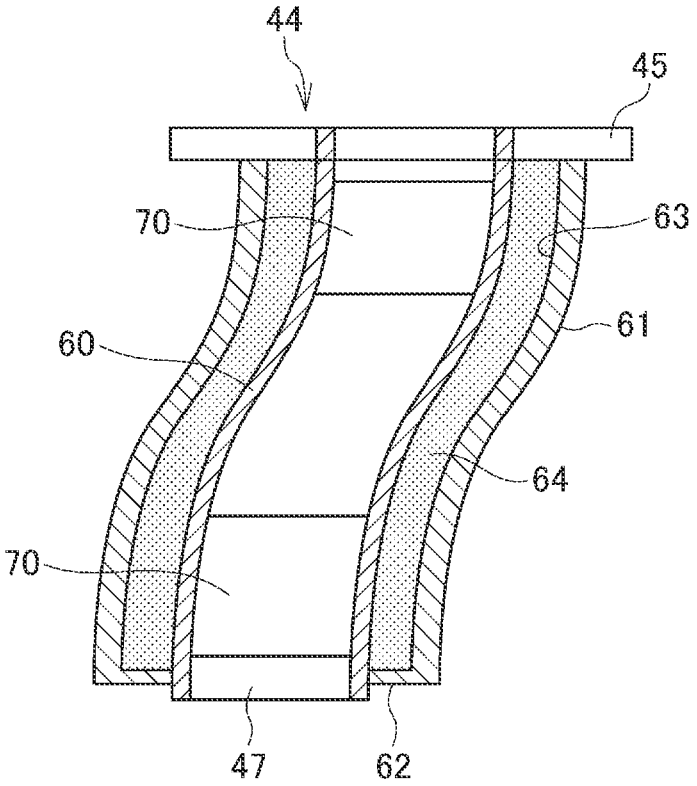
FIG. 3 is a schematic cross-sectional view illustrating details of exhaust pipes.

FIG. 2 is a schematic block diagram schematically illustrating an exhaust structure of the engine. FIG. 3 is a schematic cross-sectional view illustrating details of exhaust pipes.

As illustrated in FIG. 2, the engine E is a multicylinder gasoline engine E and includes two cylinder heads. Each of the cylinder heads is connected to a box-shaped exhaust manifold 39. Below the exhaust manifolds 39, an oil pan 35 is attached via the mount case 1.

Below both sides of the oil pan 35, two exhaust pipes 44 are attached.

A downstream side of each of the exhaust pipes 44 is configured such that the pipe extends downward, enters the inside of the extension case 2, and discharges the exhaust gas into water.

As illustrated in FIG. 3, each of the exhaust pipes 44 is doubly formed and is constituted of an inner pipe 60 and an outer pipe 61 which is located outside this inner pipe 60. On one end portion of each of the inner pipe 60 and the outer pipe 61, a flange 45 is formed so as to retain the inner pipe 60 and the outer pipe 61 at a predetermined interval, and on the other end portion of each of the inner pipe 60 and the outer pipe 61, a closure plate 62 which is connected to an outer circumferential surface of the inner pipe is included. Between the inner pipe 60 and the outer pipe 61, a space 63 is formed.

In the present embodiment, the outer pipe 61 is formed to be thick and is configured so as to ensure predetermined strength and stiffness. In contrast to this, the inner pipe 60 is formed to be thinner relative to the outer pipe 61 and is configured so as to be capable of lowering a heat capacity and inhibiting heat reception.

Inside the inner pipe 60, in the present embodiment, two catalysts 70 as catalytic converters are installed. Each of the catalysts 70 is a three-way catalyst which removes harmful components such as hydrocarbons (HC), carbon monoxide (CO), and nitrogen oxides (NOx) in exhaust gas by oxidation-reduction reaction and has a honeycomb catalyst structure obtained, for example, by coating a porous honeycomb structure with a catalyst component such as platinum, palladium, and rhodium. Note that the structure of each of the catalysts 70 is not limited to the honeycomb catalyst structure and may be a simplified structure such as a plate catalyst structure with the catalyst component carried on a plate member.

Note that a number of the catalysts 70 is not limited to two and, one or three or more thereof may be installed.

For each of the exhaust pipes 44, a heat insulation structure which hardly transmits heat received from an outside of the outer pipe 61 to the inner pipe 60 is adopted.

Specifically, in the space 63 between the inner pipe 60 and the outer pipe 61 of each of the exhaust pipes 44, for example, a heat insulation material 64 is incorporated. As this heat insulation material 64, glass wool, rock wool, a reinforced carbon composite material, or the like, which is flame-retardant, is used. By incorporating the heat insulation material 64, the structure which hardly transmits the heat from the outer pipe 61 to the inner pipe 60 can be obtained. As a result, an inside of the inner pipe 60 can be retained by the exhaust gas at a predetermined temperature.

In addition, as other heat insulation structure, the space 63 between the inner pipe 60 and the outer pipe 61 of each of the exhaust pipes 44 may be configured, for example, so as to be at a low pressure or be vacuum. Thus, the heat from the outer pipe 61 is insulted by the space 63, thereby obtaining the structure which hardly transmits the heat to the inner pipe 60.

In this case, it is preferable that an outer circumferential surface of the inner pipe 60 and an inner circumferential surface of the outer pipe 61 are subjected to mirror finish. By conducting the mirror finish as mentioned above, heat transmission from the outer pipe 61 to the inner pipe 60 can be reduced.

Figure 4:
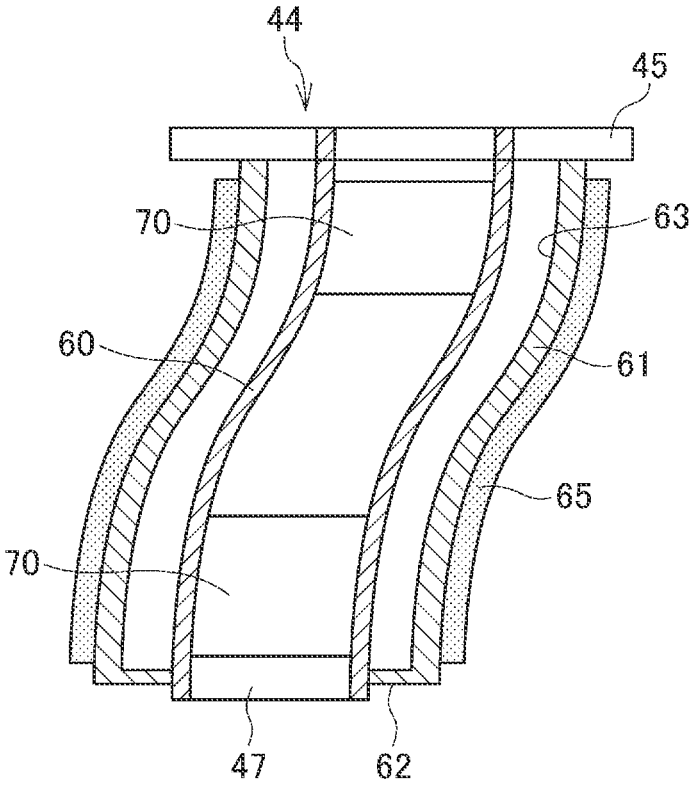
FIG. 4 is a schematic cross-sectional view illustrating other heat insulation structure.

FIG. 4 is a schematic cross-sectional view illustrating other heat insulation structure.

As illustrated in FIG. 4, as the other heat insulation structure, a foamed plastic-based heat insulation material 65 may be installed on an outer surface of the outer pipe 61. As the foamed plastic-based heat insulation material 65, for example, a foamed plastic-based heat insulation material 65 such as extruded foamed polystyrene, expanded poly-styrene, urethane foam, highly foamed polyethylene, and phenol foam is used. Since a temperature of the outer pipe 61 is comparatively low, even the heat insulation structure is formed of the foamed plastic-based heat insulation material 65, a problem such as fusion is not caused.

Note that in the heat insulation structure, the heat insulation material 64 may be installed in the space 63 and the foamed plastic-based heat insulation material 65 may be installed, or only any one of the heat insulation material 64 and the foamed plastic-based heat insulation material 65 may be installed.

In addition, the inner pipe 60 of each of the exhaust pipes 44 is formed from tube members, which are two halves divided along an axis direction of the inner pipe 60. In other words, the inner pipe 60 is formed by mutually welding and joining the two halves with the catalysts 70 contained inside the tube members having half-divided shapes.

Note that the inner pipe 60 may be constructed by joining tube members divided along a direction orthogonal to the axis direction of the inner pipe 60.

Figure 5:
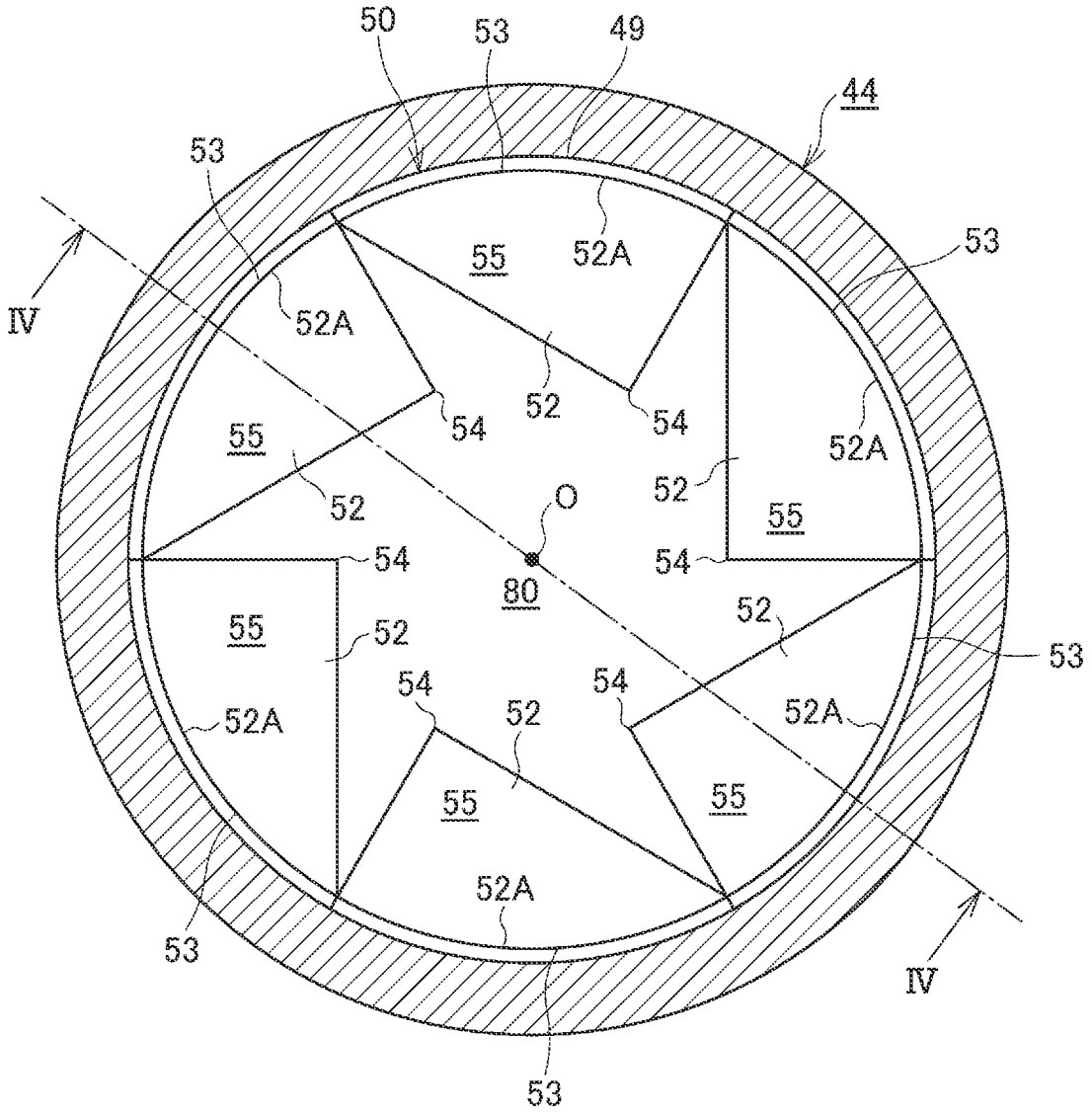
FIG. 5 is a diagram schematically illustrating a configuration of a watering inhibition mechanism according to the present embodiment.
Figure 6:
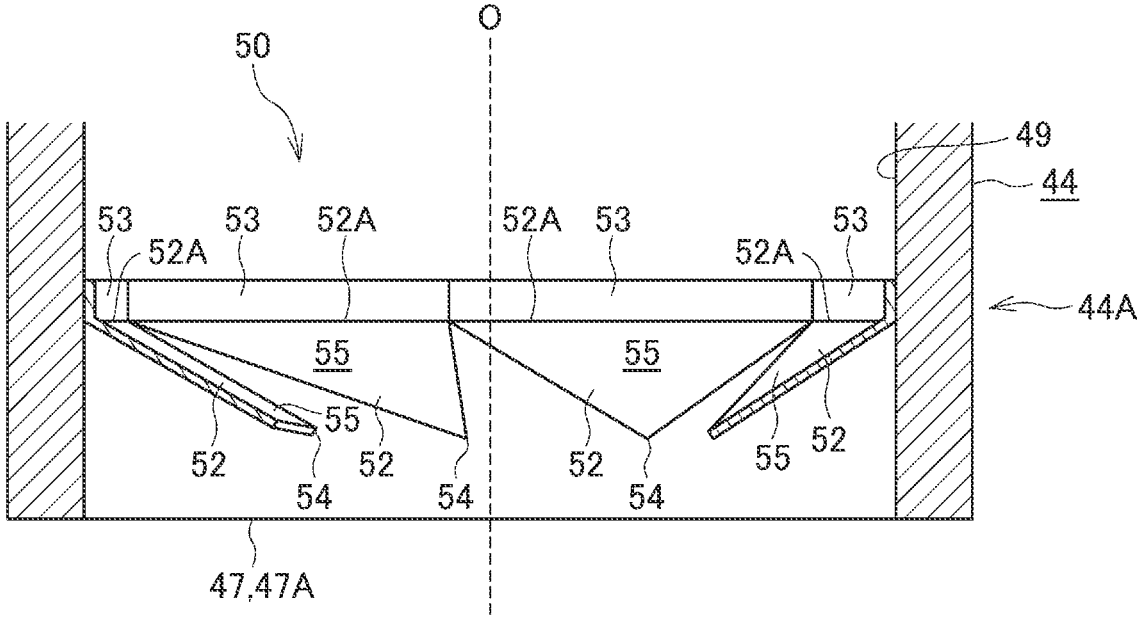
FIG. 6 is a cross-sectional view taken from line VI-VI in FIG. 5.

FIG. 5 is a diagram schematically illustrating a configuration of a watering inhibition mechanism 50 according to a second embodiment of the present invention. FIG. 6 is a cross-sectional view taken from line VI-VI in FIG. 5.

As illustrated in FIGS. 5 and 6, the watering inhibition mechanism 50 is provided for the exhaust port 47 of each of the exhaust pipes 44.

The watering inhibition mechanism 50 in the present embodiment includes a plurality of plates 52 (six plates in FIG. 5). Each of the plates 52 is formed in such a way that for example, a metal material which is excellent in corrosion resistance, durability, and stiffness is formed to have a substantially triangular shape. One side 52A of each of the plates 52 has an arc shape whose curvature matches a curvature of a pipe wall 49 inside each of the exhaust pipes 44, and the one side 52A is provided with a fixing margin 53. The fixing margin 53 is a fixing piece which extends substantially perpendicularly to the one side 52A of each of the plates 52. On the lower end part 44A of each of the exhaust pipes 44, the fixing margin 53 is fixed to the pipe wall 49 by welding, and thus, as illustrated in FIG. 4, the plurality of plates 52 are located on the lower end part 44A of each of the exhaust pipes 44, that is, in the vicinity of the exhaust port 47.

As illustrated in FIG. 5, the plates 52 are attached along a peripheral surface of the pipe wall 49 at substantially equal intervals and substantially in contact with each other. These plates 52 are provided for the lower end part 44A of each of the exhaust pipes 44, thereby inhibiting exposure of water to the exhaust port 47 of each of the lower end part 44A. A size of each of the plates 52 is determined by an area of a gap 80 which should be formed in a center O of a cross section of the exhaust port 47, and this area of the gap 80 is determined by an allowable value of an exhaust pressure or the like.

Note that a technique of fixing each of the plates 52 to the pipe wall 49 is not limited to the technique of fixing the fixing margin 53 thereto by welding and may be a technique of fixing the fixing margin 53 thereto by riveting. In this case, a recessed portion which receives a rivet is formed in advance in the pipe wall 49, and in a state in which a leading end of the rivet passed through the fixing margin 53 is inserted into the recessed portion of the pipe wall 49, the rivet is waged, thereby fixing the fixing margin 53 thereto.

As illustrated in FIG. 6, each of the plates 52 is bent at the fixing margin 53 in such a way that a corner part 54 facing the fixing margin 53, that is, the corner part 54 which is nearest to the center O of each of the exhaust pipes 44 is located below the fixing margin 53 (on a side of the exhaust port 47), and thus, water which has got on each of the plates 52 travels on an upper surface 55 and easily flows down.

Note that a plurality of stages of the plates 52 may be provided in an up-down direction (extending direction) of each of the exhaust pipes 44. The plurality of stages of the plates 52 are provided, thereby allowing watering inhibition effect to be enhanced.

Next, operation of the present embodiment will be described.

In the present embodiment, by driving the engine E, a driving force of the engine E is transmitted to the propeller shaft 8 via the crank shaft 4 and the driving shaft 6, and this rotates the propeller, thereby advancing and backing the boat.

The exhaust gas exhausted from the cylinder heads of the engine E is sent from the exhaust manifolds 39 via the mount case 1 to the exhaust pipes 44.

Then, in the exhaust pipes 44, the harmful components in the exhaust gas are removed by the oxidation-reduction reaction caused by the catalysts 70, and the exhaust gas is exhausted to the extension case 2 via the exhaust ports 47 of the exhaust pipes 44 and thereafter, is exhausted into water from a portion of the propeller.

In this case, although a temperature outside the exhaust pipes 44 is comparatively low due to influence of water entering the waterline, in order to favorably cause the oxidation-reduction reaction of the catalysts 70, it is required to retain the above-mentioned temperature at a predetermined temperature.

In the present embodiment, since each of the exhaust pipes 44 has the double structure constituted of the inner pipe 60 and the outer pipe 61, the inside of the inner pipe 60 is warmed at the predetermined temperature by the exhaust gas sent from each of the cylinder heads of the engine E via each of the exhaust manifolds 39 to each of the exhaust pipes 44. Since owing to the double-pipe structure, a temperature outside the outer pipe 61 is hardly transmitted to the inner pipe 60, the inside of the inner pipe 60 is retained at the predetermined temperature by the exhaust gas. Thus, the oxidation-reduction reaction of the catalysts 70 which are located inside the inner pipe 60 can be favorably caused.

As described hereinbefore, in the present embodiment, the exhaust pipes 44 which are connected to the exhaust manifolds 39 of the engine E of the outboard motor are included, the catalysts 70 are installed inside each of the exhaust pipes 44, at least a portion of each of the exhaust pipes 44, which corresponds to a place where the catalysts 70 are installed is formed to have the double structure constituted of the inner pipe 60 and the outer pipe 61.

Thus, the inside of the inner pipe 60 is warmed at the predetermined temperature by the exhaust gas which is sent from the cylinder heads of the engine E via the exhaust manifolds 39 to the exhaust pipes 44, and since the temperature outside the outer pipe 61 is hardly transmitted to the inner pipe 60 owing to the double-pipe structure, the inside of the inner pipe 60 is retained at the predetermined temperature by the exhaust gas. Thus, the oxidation-reduction reaction of the catalysts 70 which are located inside the inner pipe 60 can be favorably caused. In addition, since the catalysts 70 are installed inside the inner pipe 60 of each of the exhaust pipes 44, it is not required to separately provide a space for installing the catalysts 70 and a space where the catalysts 70 are installed can be made small. As a result, the outboard motor 10 can be downsized.

In addition, in the present embodiment, the portion of the double structure of each of the exhaust pipes 44 has a heat-resistant structure.

Thus, since the portion of the double structure of each of the exhaust pipes 44 has the heat-resistant structure, the temperature outside the outer pipe 61 can be further hardly transmitted to the inner pipe 60 and the inside of the inner pipe 60 can be retained at the predetermined temperature by the exhaust gas.

The above-described embodiment is merely one embodiment of the present invention, and any modifications and applications can be made without departing from the spirit of the present invention.

For example, although in the above-described embodiment, the case where the engine E is the gasoline engine is described, the engine E may be an engine, such as a diesel engine, for which the purification of the exhaust gas is required. As each of the catalysts 70, it is only required to select an appropriate catalyst 70 in accordance with the engine E, and for example, in a case of the diesel engine, it is only required to use a catalyst 70, such as a selection catalyst reduction (SCR) catalyst 70 or a soot catalyst (SC) 70, which is suited for the diesel engine.

REFERENCE SIGNS LIST

10 Outboard motor
26 Cylinder block
27 Cylinder head
35 Oil pan
44 Exhaust pipe
47 Exhaust port
50 Watering inhibition mechanism
60 Inner pipe
61 Outer pipe
63 Space
64 Heat insulation material
65 Foamed plastic-based heat insulation material
70 Catalyst
B Boat
C Casing
E Engine

The invention claimed is:

1. An outboard motor catalytic converter comprising:

an exhaust pipe that is connected to an exhaust manifold of an engine of an outboard motor, wherein inside the exhaust pipe, a catalyst is installed, and at least a portion of the exhaust pipe where the catalyst is installed is formed to have a double structure constituted of an inner pipe and an outer pipe, the outer pipe has a thickness, and the inner pipe is formed to have a thickness that is smaller than the outer pipe thickness, and the outboard motor catalytic converter comprises, at an exhaust port of the exhaust pipe, a watering inhibition mechanism formed of a plurality of plates extending along a peripheral surface downwardly and toward a center of the exhaust pipe.

2. The outboard motor catalytic converter according to claim 1, wherein a portion of the double structure of the exhaust pipe has a heat-resistant structure.

3. The outboard motor catalytic converter according to claim 2, wherein the heat-resistant structure is constructed with any of glass wool, rock wool, or a reinforced carbon composite material incorporated in a space between the inner pipe and the outer pipe.

4. The outboard motor catalytic converter according to claim 2, wherein the heat-resistant structure is constructed with a plastic-based heat insulation material installed on an outer surface of the outer pipe.

5. The outboard motor catalytic converter according to claim 4, wherein the plastic-based heat insulation material is any of extruded foamed polystyrene, expanded poly-styrene, urethane foam, highly foamed polyethylene, or phenol foam.

6. The outboard motor catalytic converter according to claim 2, wherein in the heat-resistant structure, a space between the inner pipe and the outer pipe is at a low pressure or is vacuum.

7. The outboard motor catalytic converter according to claim 6, wherein the heat-resistant structure is constructed by subjecting an outer surface of the inner pipe and an inner surface of the outer pipe to mirror finish.

8. The outboard motor catalytic converter according to claim 1, wherein the portion, of the exhaust pipe, where the catalyst is installed is formed by joining tube members by welding, the tube members being the exhaust pipe divided into two halves.

9. The outboard motor catalytic converter according to claim 1, wherein as the catalyst, two catalysts are installed.

* * * * *